United States Patent [19]

Palomo et al.

[11] 4,220,100

[45] Sep. 2, 1980

[54] SYMMETRICAL PALLETS

[76] Inventors: Manuel W. Palomo, 2530 Thornlodge Dr., Mississauga, Ont. L5K 1K5, Canada; Michael B. Kitchen, 1132 Greenoaks Dr., Mississauga, Ont. L5H 3A2, Canada

[21] Appl. No.: 15,955

[22] Filed: Feb. 28, 1979

[51] Int. Cl.[2] ..... B65D 19/32

[52] U.S. Cl. ..... 108/51.1; 52/801; 52/802; 108/57.1

[58] Field of Search ..... 108/51.1, 51.3, 52.1, 108/53.1, 53.3, 55.1, 56.1, 57.1, 901, 902; 206/386, 596, 599, 600; 52/799, 801, 802, 823

[56] References Cited

U.S. PATENT DOCUMENTS

| | | | |
|---|---|---|---|
| 2,094,381 | 9/1937 | Slayter | 52/823 X |
| 2,348,307 | 5/1944 | Richardson et al. | 52/823 X |
| 2,840,430 | 6/1958 | Winer | 108/51.1 X |
| 3,118,400 | 1/1964 | Kemp, Jr. et al. | 108/57.1 |
| 3,757,704 | 9/1973 | Allgeyer et al. | 108/51.1 |

FOREIGN PATENT DOCUMENTS

| | | | |
|---|---|---|---|
| 1300909 | 7/1962 | France | 108/51.1 |

*Primary Examiner*—William E. Lyddane

[57] ABSTRACT

A composite pallet comprised of a plurality of structural components including a pair of solid, exterior decks, an interior fork entry core portion and a pair of load distributing truss members, located, stressed and locked in place by means of a perimeter compression strip yields a structural and functional unit. The pallet is made from materials which permit it to be immersion cleaned without degrading. The pallet is further characterized by its inherent symmetry.

11 Claims, 9 Drawing Figures

FIG.1.
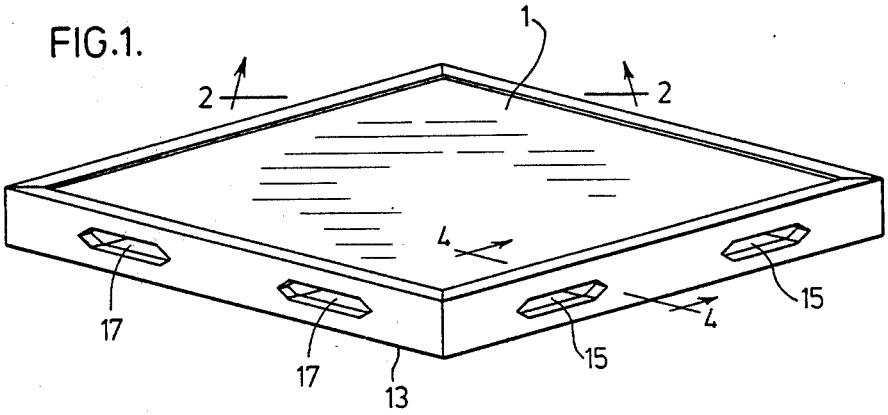
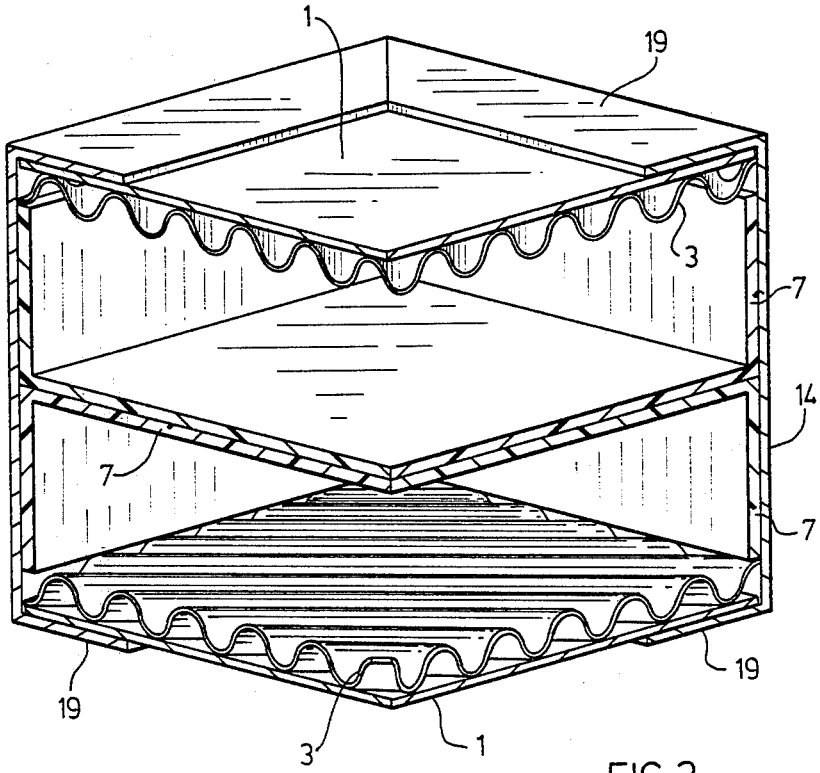
FIG.2.

SYMMETRICAL PALLETS

FIELD OF THE INVENTION

The present invention relates to a unitized composite pallet.

BACKGROUND OF THE INVENTION

Conventional pallets are primarily used in industry for the storing of goods in plants or for the carrying of the goods from the plant to shipping. However, because they are generally designed strictly for use with in-house equipment such as lift-trucks or hand trolleys, they are not compatible as a part of the total materials handling chain from beginning to end. Furthermore, most present day pallets are of the stringer variety made from wood, secured by nails, or screws, which tend to rust and pop from the pallets. The wood itself, is subject to breakage, deterioration and rot, rendering the wooden pallet useless, particularly for carrying packaged goods which catch and tear on the broken wood stringers or for carrying sanitary goods which become contaminated when coming into contact with the rotting wood. The whole pallet tends to skew and change shape after relatively limited use causing jamming problems in automated equipment.

Some attempts have been made to overcome the drawbacks of stringer-type pallets. For example, plywood decks have been developed as a way of avoiding damage to products from broken stringers. However, these plywood deck wooden pallets have done little to overcome the difficulties encountered in the overall handling chain of materials. They are extremely heavy and awkward to work with and they still suffer from the deterioration problems discussed above.

Other attempts have been made to use steel, aluminum and plastic materials in pallet constructions. However, these attempts have been designed to be wood pallets using an alternate material and therefore, are still not acceptable. One of the factors that has to be considered in the total materials handling chain, is the manual labour involved, and present day steel and aluminum pallets have been constructed without taking this factor into consideration, exposing sharp edges which can severely cut an individual, handling the pallet.

The pallet of the present invention has been constructed to overcome the drawbacks of the prior art and is therefore, different in both design and concept, from conventional pallet structures. It is a radical departure from the prior art in pallet construction and uses materials in new ways, to the best structural and functional advantages, to provide a unitized composite pallet formed by structural components bound by a perimeter compression strip. According to the broadest aspect of the invention, the structural components comprise a pair of solid flat exterior decks, an interior fork entry core portion, and the perimeter compression strip. The perimeter compression strip is generally U-shaped, having leg portions wrapping around the outer surfaces of the exterior decks, a base portion at the outer edge of the pallet and being provided with a plurality of fork entries surrounded interiorly by inwardly extending tab portions. These are spaced along the length of the perimeter compression strip with the tab portions fitted into the interior fork entry core portion. The leg portions and the base portion co-operate with the tab portions to locate, to stress and to lock the structural components in place. The pallet is constructed from highly durable and generally lightweight materials. Examples of such materials include metallic materials, plastic materials, a combination of metallic and plastic materials, composite materials or any other suitable highly durable and high strength materials. In addition to making the pallet adapted for immersion cleaning these materials make the pallet light in weight for manual labour. Furthermore, the perimeter compression strip is designed to avoid any sharp edges on the pallet, so that it is easily managed by persons handling the pallet.

The provision of a solid, flat exterior deck on both sides of the pallet makes the pallet reversible and further provides flat working surfaces for accommodating almost any type of good.

The present invention pallet as described above, is designed to be an integral part of the total materials handling chain, from beginning to end. The features of the present invention pallet allow its interaction with lift trucks, stacking cranes, weight scales, automatic inventory control devices, computerized rack storage and retrieval systems, automated strapping machines, shrink bagging and stretch wrapping equipment and any type of conveyor system. It can interact with transport vehicles, such as roller-bed truck trailers, railway cars and overseas containers, and the load and unload systems associated therewith.

BRIEF DISCUSSION OF THE DRAWINGS

The above, as well as other advantages and features of the present invention will be described in greater detail in the following detailed description of the preferred embodiments where:

FIG. 1 is a perspective view looking down on a preferred arrangement of a unitized composite pallet according to the present invention.

FIG. 2 shows an enlarged pallet section taken through the lines 2—2 of FIG. 1.

Figure 5:
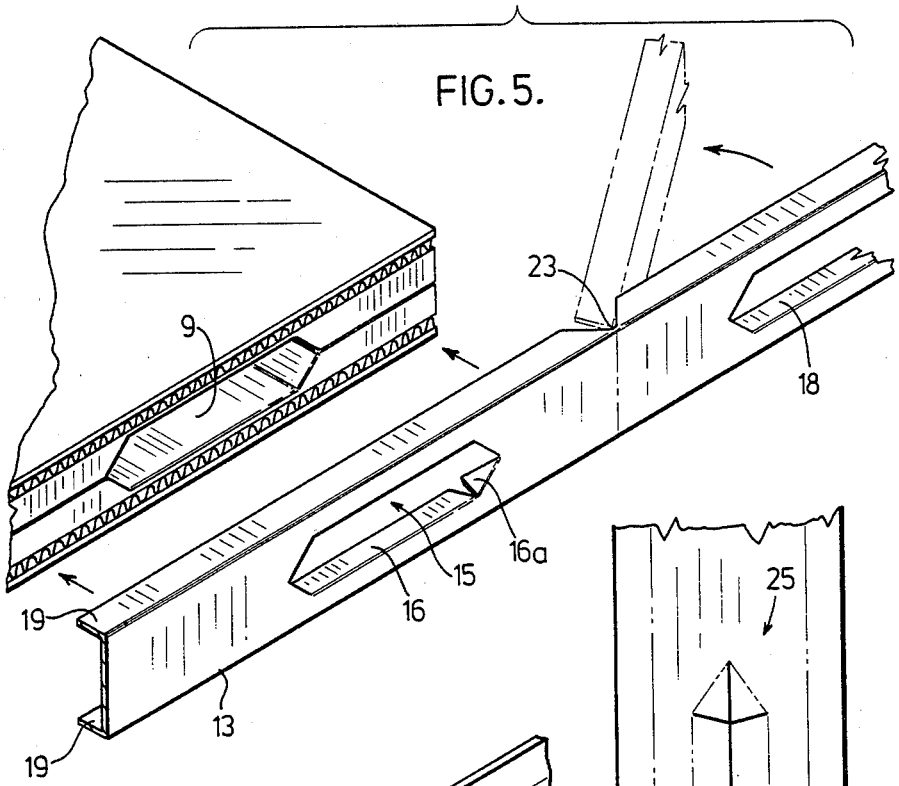
Figure 7:
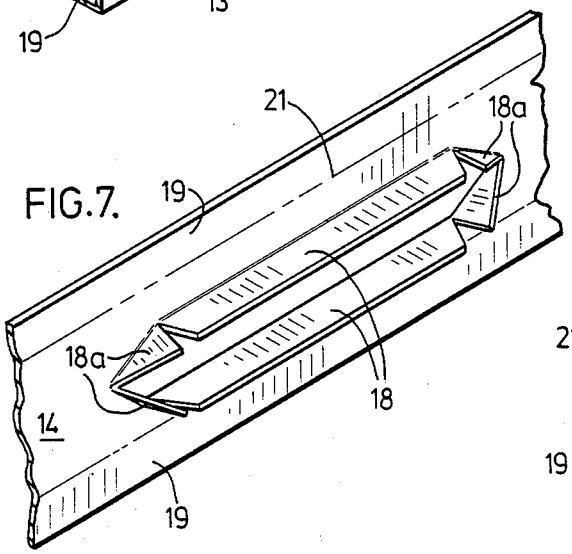

FIG. 5 a perspective view of a preferred arrangement of a compression perimeter strip removed from the pallet of FIG. 1.

FIGS. 6 through 9, show various aspects of the perimeter compression strip of FIG. 5.

DETAILED DESCRIPTION ACCORDING TO THE PREFERRED EMBODIMENTS OF THE PRESENT INVENTION

Figure 3:
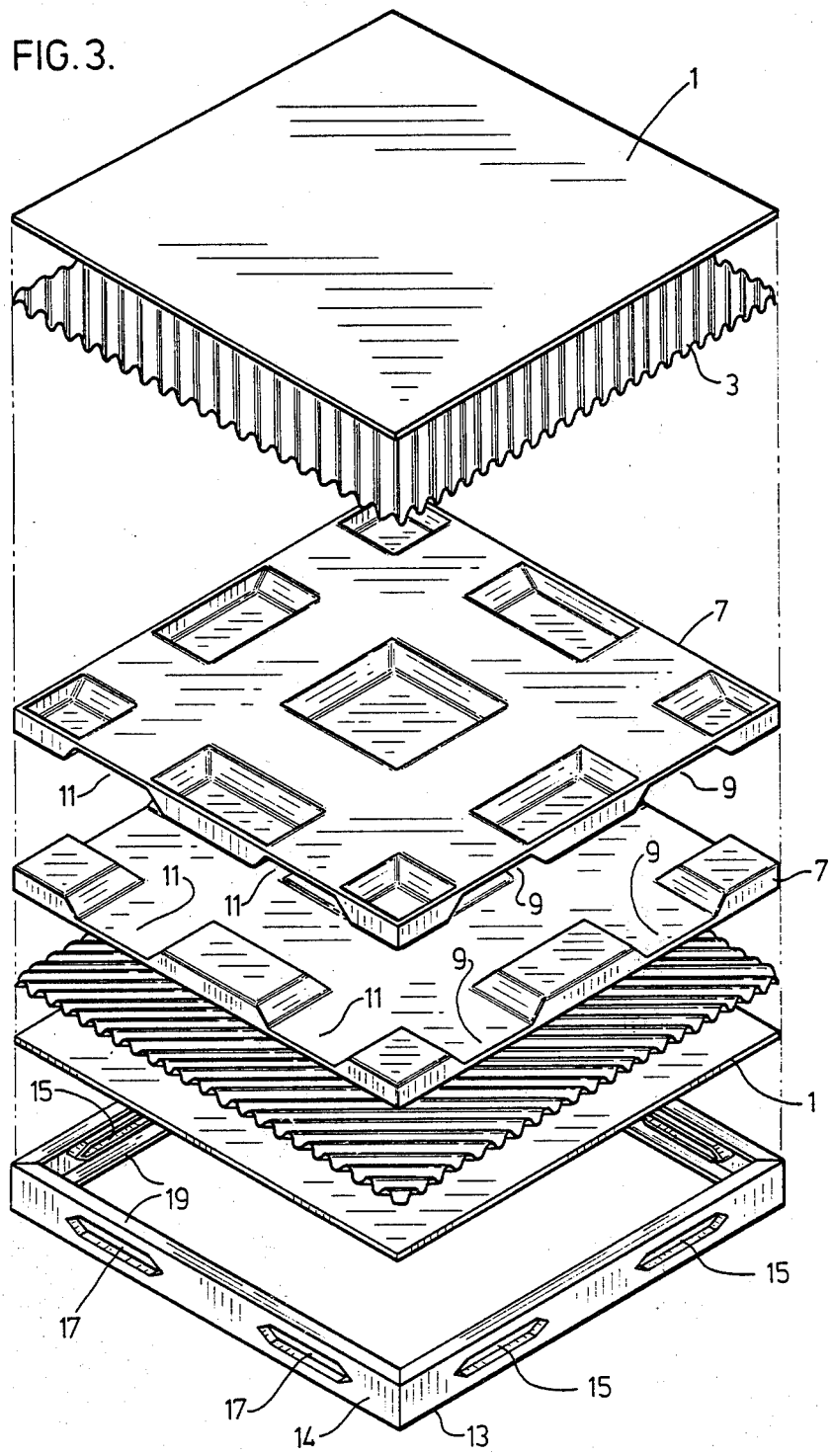
FIG. 3 is an exploded view of the preferred arrangement of a pallet shown in FIG. 1.

Referring first to FIG. 3, the pallet according to that embodiment comprises a pair of external, flat, solid decks 1, located at each of the outer faces of the pallet. Located at the centre of the pallet is a central core portion and comprising a pair of core sections 7. Sandwiched between the core sections 7 and each of the external decks 1, is a corrugated truss member 3. These truss members can also by honeycombed for purposes of distributing loads over the entire pallet. The perimeter compression strip 13 which integrates the pallet is wrapped around its entire perimeter and locates, stresses and locks the structural components in place.

Figure 8:
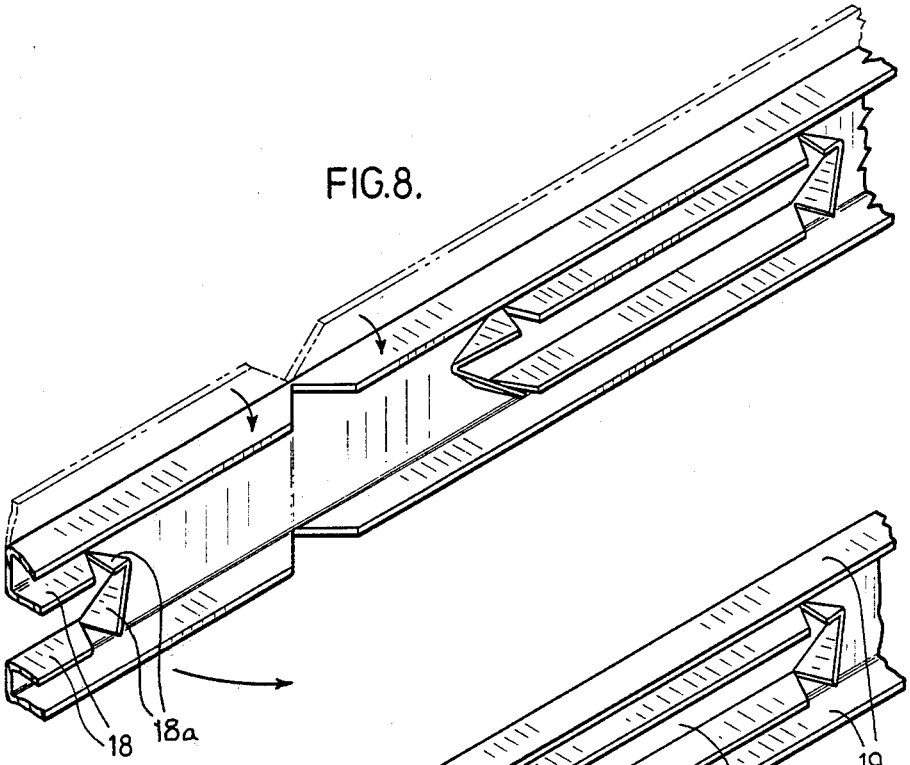
Figure 9:
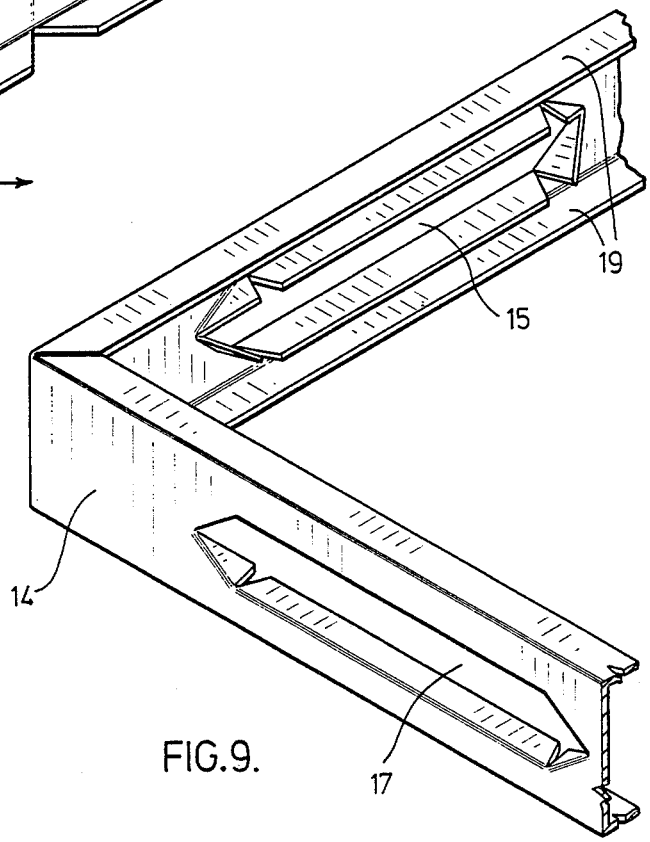

Perimeter compression strip 13 comprises a base portion 14, inwardly extending leg portions 19 and fork entries 15 and 17 surrounded interiorly by inwardly extending tab portions 16, 16*a* and 18, 18*a* respectively. These features are best seen in FIGS. 8 and 9 and their co-operative function for integrating the components will be discussed later in detail.

Returning to FIG. 3, it will be noted that the protective decks provided on both faces of the pallet provide both a flat working surface as well as a flat supporting surface. Therefore, when the pallet is supporting a load, that load is distributed over the total surface on both the top and the bottom of the pallet. This is not only important for supporting goods which would otherwise be damaged on conventional stringer pallets but is also significant when pallets are stacked on top of a product such as bottles, where an uneven bottom would result in crushing of the product if point loads were applied in areas where no bottles were present. This problem is completely avoided by the deck arrangement of the present invention.

Sections 7 pressed against one another to form the interior fork entry core portion, are identical to one another. These two sections which are protected from damage by the exterior decks are formed with two symmetrical channels 9 extending completely through both of the sections. Located at 90° to channels 9, are a second pair of symmetrical channels 11 which again run completely through both of the sections. All of the above channels are in effect, provided by embossed areas on each of the sections 7 and the sections are turned such that these embossed areas mate with one another, to provide four entry fork cores through the interior core portion, two of which run in one direction and the other two of which run at 90° to the first two.

When the pallet is fully assembled, as shown in FIG. 1, these channels or fork entry cores are fully enclosed within the pallet. Their enclosed design ensures that all loads are symmetrically placed on the pick-up forks of a lift truck handling the pallet. Since the fork entry cores are essentially an enclosure for the entire fork, any forward or sideways tilting of the pallet is restricted to a few degrees thereby providing a significant safety feature. Furthermore, the flat surface area of a fork entry core in contact with the fork surface, effectively distributes the load over the entire pallet in contrast to the point loading experienced with conventional stringer type pallets.

Figure 4:
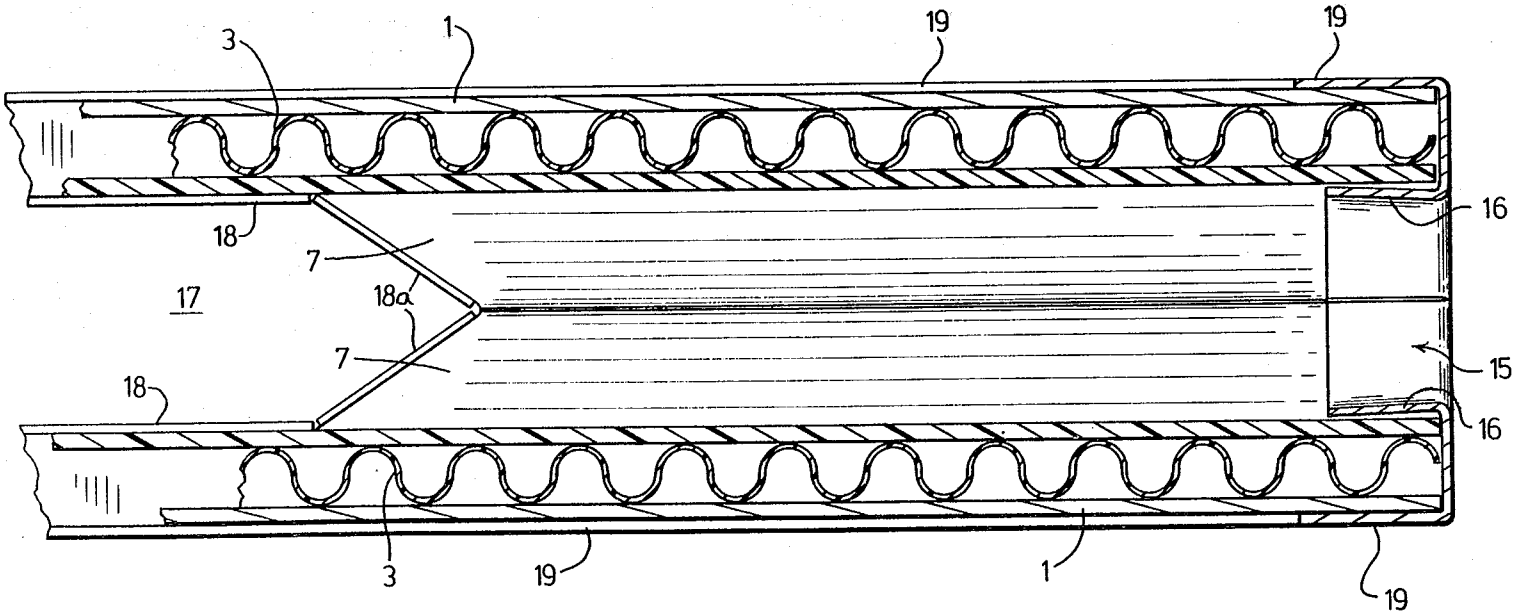
FIG. 4 shows a pallet section taken along the lines 4—4 of FIG. 1.

Referring now to FIGS. 2 and 4, it will be seen that due to their corrugated construction, each of the truss members 3 only comes into line contact with both the interior core portion and its association exterior deck. However, also as a result of the corrugated construction, each of these truss members is able to effectively distribute applied loads over the entire pallet surface, along the corrugations. As mentioned above, the trusses could have some other type of construction, such as a honeycomb construction which would also effectively distribute loads over the entire pallet.

In some cases, it may be desirable to bond the truss members to both the interior core portion and the exterior decks during assembly, prior to mounting the perimeter compression strip. However, in such cases, it is still the perimeter compression strip which provides the final locating and securing together of the components.

Once the structural components have been fitted in place, as shown in FIG. 5, the perimeter compression strip is then mounted to integrate the structural components and to provide the unitized composite pallet of the present invention.

Figure 6:
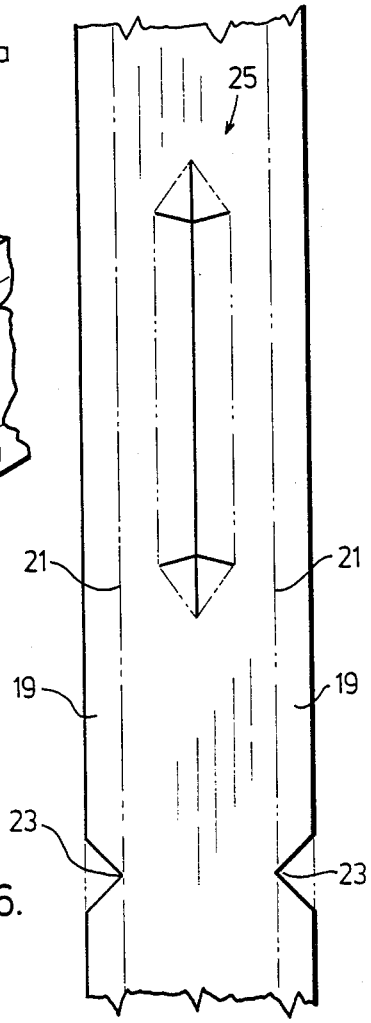

The perimeter compression strip is initially prepared from a flat, extended stip of material as shown in FIG. 6. The strip of material is scored, as indicated at 21 and cut as indicated at 23 and generally at 25. The strip is then fitted along one of the outer edges of the assembled structural components with cuts 23 being located at one of the corners. The strip is then folded around the corner and bent at 90° as is being indicated in FIG. 5. Further cuts are provided along the length of the compression strip so that it is fully folded around the outside edge of the pallet with the free ends of the strip secured together by suitable securing frame.

Once the perimeter compression strip is in place around the perimeter of the pallet, it is then folded along score lines 21 to provide leg portions 19 overlapping the outer surfaces of the exterior decks as well as base portion 14, facing outwardly from the extreme edge of the pallet. A punch mechanism (not shown) is then forced through cut lines 25 to provide fork entries 15 and 17 and tabs comprising portions 16, **16*a* and 18, 18*a*, respectively, which are pressed into fork cores 9 and 11 respectively. These tab portions which are bent slightly more than 90° by the punch mechanism co-operate with both the base and the leg portions on the perimeter compression strip by their combined clamping action for locating, stressing and locking the structural components together, as a composite unit. More specifically, when the tabs are punched and bent beyond 90°, portions 16 and 18 (the upper and lower tab portions) clamp on the components sandwiched between each tab and the nearest leg portion of the perimeter compression strip to prevent vertical shifting of the components. At the same time portions 16*a* and 18*a* of the tabs which are also bent past 90° co-operate with the opposing base portion (i.e. the part of the base portion running at 90° to the fork entry in question) to clamp on the material sandwiched therebetween which in combination with the overall wrapping effect of the parimeter compression strip prevents any horizontal shifting of the components. Furthermore, as can be clearly seen in FIG. 2, leg portions 19** extend inwardly so that there are no sharp edges exposed at the outside of the pallet where it is handled.

Since leg portions 19 are raised slightly with respect to decks 1, and because base portion 14 surrounds the entire outer edge of the pallet, the perimeter compression strip additionally functions as a bumper and scuff bar, avoiding much of the wear and tear that would be normally placed on the working deck.

With the exception of the fork entries, the perimeter compression strip is an essentially solid surface around the perimeter of the pallet and therefore, functions as an attachment location for identification plates, codings or the like. Furthermore the tab portions surrounding the fork entries provide both a guide and a protector to the interior core portion so that the sharp ends of the fork of a lift truck will be guided properly into position without causing any damage to the pallet. Both of these features are highly advantageous over the prior art.

As is apparent from the drawings, each of the components in the pallet is identical to its counterpart, i.e. decks 1 are identical; trusses 3 are identical and sections 7 are, as mentioned above, identical to one another. Furthermore, according to a preferred construction of the present invention, the pallet has a square shape thereby, making it totally symmetrical. This symmetry permits use of either side of the pallet as a load-bearing surface. In addition, the overall symmetry of the pallet allows an 8-way entry loading to automated pallet dispensers without manual sorting and transport on almost any conveyor system without any change in conveyor design, even with pallet direction change, which is not possible when using conventional pallets. Furthermore, because of the symmetry, the pick-up and transfer mechanisms of the present pallet have the same configuration and height specifications regardless of which edge of the pallet is presented, thereby reducing the complexity of the machine design and reducing the cost of machinery for handling the pallet.

As described above, the fork entry cores run between the embossed areas on the sections 7. These embossed areas may be provided in a number of different manners including vacuum forming or injection molding the sections. According to both of these methods depressed areas or voids appear in the core sections opposite the embossed areas as is shown in the drawings. Truss members 3 span these depressed areas to distribute loads thereover. However, other methods of spanning these voids can be used, such as by filling the voids, preferably with some type of structural lightweight material, or by spanning each of the voids individually with for instance, an X-shaped bracket arrangement. Each of these methods would also provide the truss means required to distribute the loads placed on the pallet over the voids.

According to another method of manufacturing the pallet, the truss means can be totally eliminated. This is done by affixing separate block members to a flat sheet of material to provide each of the core sections thereby eliminating the voids or depressed areas so that no truss means are required to span the voids.

The selection of materials used in the pallet and its integrated construction provide tightly held weight and dimensional tolerances with as mentioned above, particular emphasis on squareness, thereby avoiding jamming in automatic machinery. The lack of nails and screws which normally pop, as well as the non use of stringers subject to breakage, further reduces the possibility of jamming and damage caused to machines and products encountered with other types of pallets.

The pallet is designed so that it can be identified and addressed by automatic means such as stamped numbers, i.e. license plates, photo reflective tape, etc. This identity can be easily detected by photo electric sensors or optical scanners. The location of a pallet can be sensed by limit switches and both capacitant and magnetic proximity switches, which can not be used on conventional pallets because of their lack of symmetry and geometry as well as the variations in the materials used. The pallet can be permanently identified as to owner and date of manufacture so that loss is minimized and trippage and replacement figures can be accurately determined ensuring proper cost control.

The close weight tolerances of the present invention pallet also permit it to be used on weighing systems for automatic inventory control without requiring off-loading of incoming materials, counting and possibly re-palletizing onto captive pallets before dispatching to a location in an automated warehouse rack location. This eliminates another step in the flow of materials handling when compared to conventional pallets as well as eliminating the need for captive pallets in an automated warehouse environment. Furthermore, since weight tolerances are closely controlled the pallet is designed to take maximum advantages of the economies of scale.

The materials used in the manufacture of the pallet have a high strength to weight ratio and are used to the best advantage in the stressed skin construction of the present pallet, in contrast to contemporary wooden, plastic or metallic pallets. The truss members, when required, used in combination with relatively thin external decks and hollowed internal core construction, significantly reduce the weight of the pallet for purposes of any manual handling that is required. However, this minimizing of the weight and associated cost is achieved at a maximum strength. Therefore, the pallet is designed to be durable and require no maintenance. However, in the event of severe damage, the pallet can be easily recycled.

The low profile of the present pallet improves its cube-utilization and combined with its lighter weight, permits additional economies to be achieved in both storage and shipment of products and pallets. These improvements are achieved without sacrificing or compromising fork access or entry.

Another highly advantageous feature resulting from the selection of the material, is the provision of a non-combustible pallet which does not gain or lose weight over its lifetime and which is not affected by environmental conditions or age. The pallet is easily sterilized i.e. by immersion cleaning and therefore, can be widely used in food and pharmaceutical industries. The weight of the components can be varied depending on the dynamic and static load requirements of the user.

The pallet of the present invention has been designed to reduce the costs of handling throughout the materials handling chain, beginning with the storage and transport of raw materials to delivery of finished goods to the consumer. The basic design of the present pallet permits standardization and simplified machine design which results in a high degree of reliable operation which in turn results in reduced line supervision. Few repetitive parts are used and the assembly can be readily automated.

Although the various preferred embodiments of the invention have been described herein, in detail, it will be apparent to one skilled in the art, that variations may be made thereto, without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. A unitized composite pallet formed by a plurality of structural components comprising a pair of solid flat exterior decks, an interior fork entry core portion and a perimeter compression strip integrating said structural components, said perimeter compression strip being generally U-shaped having an outwardly facing base portion, and inwardly extending leg portions overlapping said exterior decks and being provided with a plurality of fork entries spaced along its length surrounded interiorly by inwardly extending tab portions fitted into said interior fork entry core portion; said leg portions and said base portion co-operating with said tab portions to locate, stress and lock said structural components in place, said tab portions providing a guide and a protector to said interior core portion.

2. A unitized composite pallet as claimed in claim 1 wherein said structural components further comprise a pair of load distributing truss members sandwiched between the exterior decks, one on either side of said interior fork entry core portion.

3. A unitized composite pallet as claimed in claim 2 wherein said load distributing truss members are corrugated.

4. A unitized composite pallet as claimed in claim 2, made from metallic materials.

5. A unitized composite pallet as claimed in claim 2 wherein said lead distributing truss members are bonded by adhesives to the interior fork entry core portion and the exterior decks.

6. A unitized pallet as claimed in claim 2 made from plastics material.

7. A unitized pallet as claimed in claim 2 made from a combination of plastic and metallic materials.

8. A unitized pallet as claimed in claim 2 made from a selection of composite materials.

9. A unitized composite pallet, as claimed in claim 2 wherein said interior fork entry core portion consists of a pair of identical sections held against one another and formed to provide symmetrical enclosed fork entry cores.

10. A unitized composite pallet, as claimed in claim 9 including four fork receiving channels, two of which extend in one direction completely through the fork entry core portion, the other two of which are at 90° to said direction completely through the fork entry core portion; said perimeter compression strip being provided with eight fork entries with said tab portions fitted into said fork receiving channels.

11. A unitized composite pallet as claimed in claim 10 wherein each of said components is identical to its counterpart and having a square shape with said fork entries being located along the perimeter of said pallet such that said pallet is totally symmetrical.

* * * * *